US006155013A

United States Patent [19]

Kim

[11] Patent Number: 6,155,013

[45] Date of Patent: Dec. 5, 2000

[54] FLOORBOARD FOR CLEAN ROOMS

[75] Inventor: Chae-Won Kim, Seoul, Rep. of Korea

[73] Assignee: Hae Kwang Co., Ltd., Chungchongbuk-do, Rep. of Korea

[21] Appl. No.: 09/246,269

[22] Filed: Feb. 8, 1999

[30] Foreign Application Priority Data

Sep. 23, 1998 [KR] Rep. of Korea ..... 98-18179

[51] Int. Cl.[7] ..... E04B 5/48

[52] U.S. Cl. ..... 52/263; 52/302.1; 52/475.1; 52/630; 52/799.1

[58] Field of Search ..... 52/263, 309.7, 52/475.1, 799.1, 801.1, 630, 302.1

[56] References Cited

U.S. PATENT DOCUMENTS

| | | | |
|---|---|---|---|
| 3,497,079 | 2/1970 | Kulwiec | 211/87 |
| 4,319,520 | 3/1982 | Lanting et al. | 98/37 |
| 4,825,603 | 5/1989 | Hardwicke et al. | 52/126.6 |
| 5,144,781 | 9/1992 | Fitzner | 52/303 |
| 5,628,157 | 5/1997 | Chen | 52/263 |

*Primary Examiner*—Carl D. Friedman
*Assistant Examiner*—Phi Dieu Tran A
*Attorney, Agent, or Firm*—John P. White; Cooper & Dunham LLP

[57] ABSTRACT

A floorboard for clean rooms is disclosed. The floorboard has a support unit (110) and a tile unit (120). In the support unit (110), a plate part (111) has a plurality of engaging holes (114) on its upper surface. A support part (112) is vertically and integrally formed along the edge of the lower surface of said plate part. A plurality of reinforcing ribs (113) linearly, regularly and integrally extend on the lower surface of the plate part in a way such that the ribs are integrated with both the plate part and the support part. In the tile unit (120), a cover part (121) engages with the upper surface of the plate part. A plurality of engaging projections are (122) formed on the lower surface of the cover part at positions corresponding to the engaging holes (114) of the support unit, thus engaging with the engaging holes of the support unit. Each of the engaging projections has a ventilation hole (123) at its central portion.

FIG. 4 shows the most relevant embodiment.

5 Claims, 6 Drawing Sheets

FLOORBOARD FOR CLEAN ROOMS

BACKGROUND OF THE INVENTION

1. Field of the Invention

The present invention relates, in general, to floorboards laid on the floor of a clean room where highly integrated circuit manufacturing, optical engineering, genetic engineering, space-air engineering or medical applications are processed and, more particularly, to a floorboard for such a clean room capable of improving the productivity of such processes, and being free from emitting disagreeable odors or toxic gases, and being usable for a lengthy period of time without being deformed.

2. Description of the Prior Art

As well known to those skilled in the art, it is necessary to keep the rooms where highly integrated circuit manufacturing, optical engineering, genetic engineering, space-air engineering or medical applications are processed clean so as to accomplish an optimal environment almost completely free from dust or bacteria. Such rooms have been so-called "clean rooms".

In order to maintain a desired cleanness of such clean rooms clean, the rooms individually have to be provided with an air conditioning system capable of forcibly circulating clean air in a room by introducing fresh air into the room and expelling existing room air, which may be contaminated with dust or bacteria, to the atmosphere.

Therefore, it is necessary to keep the floor of such a room clean. In order to accomplish such a clean state of the floor, specifically designed floorboards, having a high air ventilation effect, are laid on the floor. An example of typical floorboards for such clean rooms is shown in FIGS. 1 and 2. As shown in the drawings, the typical floorboard for clean rooms comprises a plate part 10 having a desired rectangular configuration. A latticed support part 11, having a predetermined height and a latticed bottom structure, is vertically and integrally formed on the lower surface of said plate part 10, thus supporting the plate part 10 when the floorboard is laid on the floor of a clean room. Provided on the upper surface of the plate part 10 is a tile 20. The tile 20, being smooth at its upper surface and having the same size and configuration as of the plate part 10, is attached to the upper surface of the plate part 10 through a bonding layer 30 which is formed at the junction between the tile 20 and the plate part 10 using a known bonding agent. As best seen in FIG. 2, the tile 20, attached to the plate part 10, is perforated on its top area at regularly and closely spaced positions through a drilling process, thus having a great number of ventilation holes 40. In such a case, the ventilation holes 40 are individually and completely formed on both the tile 20 and the plate part 10 from the top to the bottom. A tile holder (not shown), used for stably and firmly holding the tile 20 to the plate part 10, is provided at the edge of said plate part 10.

However, the above floorboard is problematic in that since the tile 20 is attached to the upper surface of the plate part 10 through the bonding layer 30, the floorboard undesirably emits disagreeable odors or toxic gases from the bonding agent of said bonding layer 30, and being harmful to human bodies. In addition, the bonding layer 30 fails to have a thermal and moisture stability due to the intrinsic characteristics of the bonding agent, so that the bonding strength of said layer 30 may vary in accordance with environmental temperature and humidity. This allows the tile 20 to undesirably slip on the plate part 10 when the atmospheric air has a high temperature and a high humidity during, for example, a summer season. Such a low thermal stability of the bonding layer 30 also allows said layer 30 to be exceedingly hardened at a low temperature, so that the bonding layer 30 may lose its desired bonding strength during, for example, a winter season. That is, the typical floorboard may fail to firmly integrate the tile 20 to the plate part 10 due to the intrinsic characteristics of the bonding layer 30, thus being easily deformed or damaged.

Another problem experienced in the above floorboard is caused in the process of manufacturing the floorboards. In order to produce such a floorboard, it is necessary to primarily and precisely cut the tile 20 so as to allow the tile 20 to be inserted into and held by the tile holder of the plate part 10 at its edges. Thereafter, a bonding agent is applied on either the upper surface of the plate part 10 or the lower surface of the tile 20, thus forming the bonding layer 30 prior to laying the tile 20 on the plate part 10. The tile 20 is, thereafter, pressed onto the plate part 10, thus being bonded to the upper surface of the plate part 10 and forming a floorboard. The floorboard is subjected to a drilling process where the floorboard is perforated at regularly and closely spaced positions so as to form the ventilation holes 40 individually extending from the upper surface of the tile 20 to the lower surface of the plate part 10. As described above, the process of manufacturing the known floorboard for clean rooms is very complex, consuming labor and time and reducing productivity and work efficiency while producing the floorboards.

SUMMARY OF THE INVENTION

Accordingly, the present invention has been made keeping in mind the above problems occurring in the prior art, and an object of the present invention is to provide a floorboard for clean rooms, which comprises a support unit and a tile unit, the tile unit being firmly welded to and integrated with the upper surface of the support unit through an injection molding unit, thus simplifying the process of manufacturing the floorboard, being free from emitting any odors or toxic gases, and being used for a lengthy period of time.

In order to accomplish the above object, the present invention provides a floorboard for clean rooms, comprising: a support unit consisting of: a plate part provided with a plurality of engaging holes on its upper surface; a support part vertically and integrally formed along the edges of a lower surface of said plate part; and a plurality of reinforcing ribs linearly, regularly and integrally extending on the lower surface of the plate part in a way such that the ribs are integrated with both the plate part and the support part; a tile unit integrated with the upper surface of the plate part of the support unit, said tile unit consisting of: a cover part engaging with the upper surface of the plate part; and a plurality of engaging projections formed on a lower surface of the cover part at positions corresponding to the engaging holes of the support unit, thus engaging with the engaging holes of the support unit, each of said engaging projections having a ventilation hole at its central portion.

BRIEF DESCRIPTION OF THE DRAWINGS

The above and other objects, features and other advantages of the present invention will be more clearly understood from the following detailed description taken in conjunction with the accompanying drawings, in which.

DESCRIPTION OF THE PREFERRED EMBODIMENTS

Figure 1:
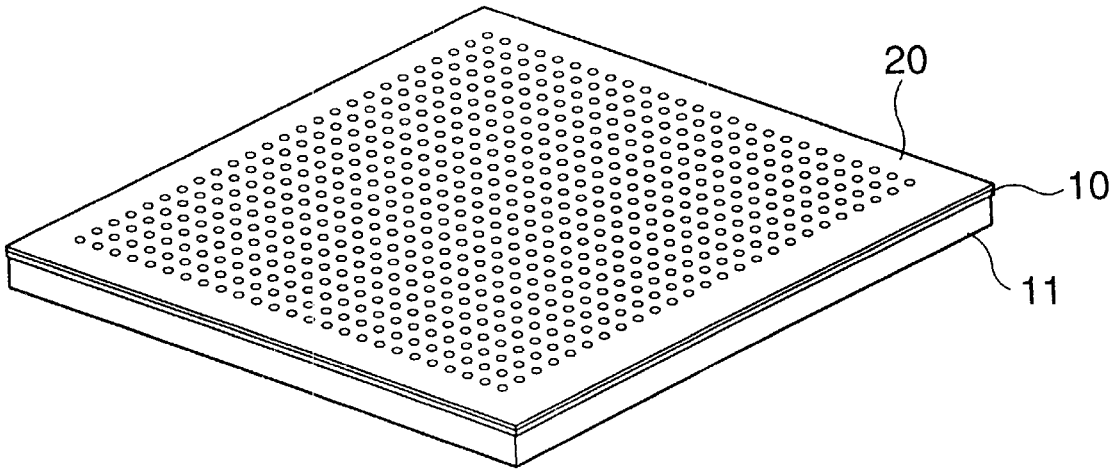
FIG.1 (Conventional Art)
FIG. 1 is a perspective view of a typical floorboard for clean rooms.
Figure 2:
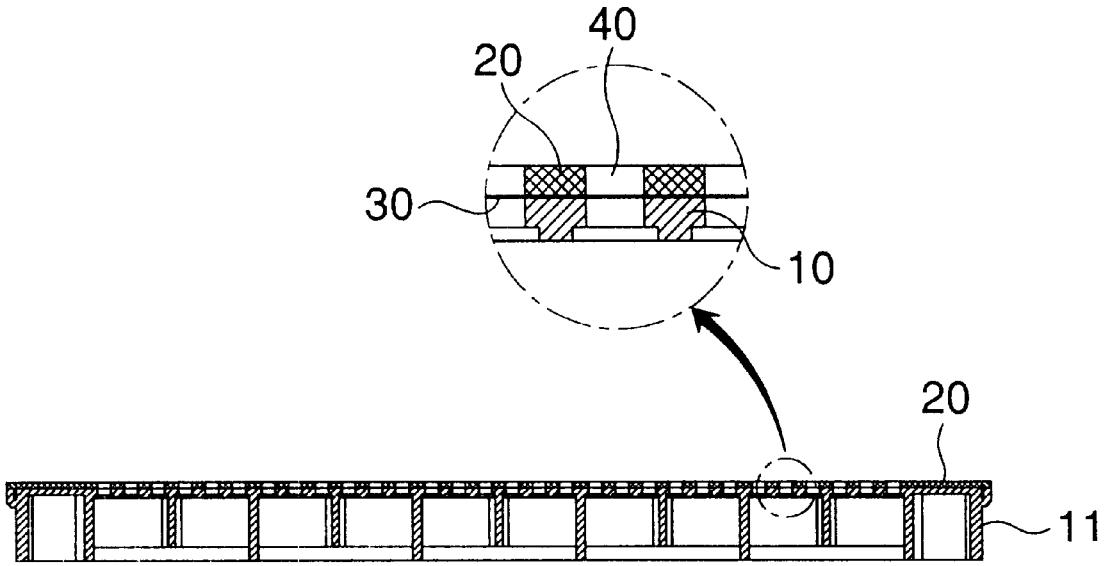
FIG.2 (Conventional Art)
FIG. 2 is a sectional view of the typical floorboard for clean rooms, showing the cross-sectioned construction of the floorboard.
Figure 3:
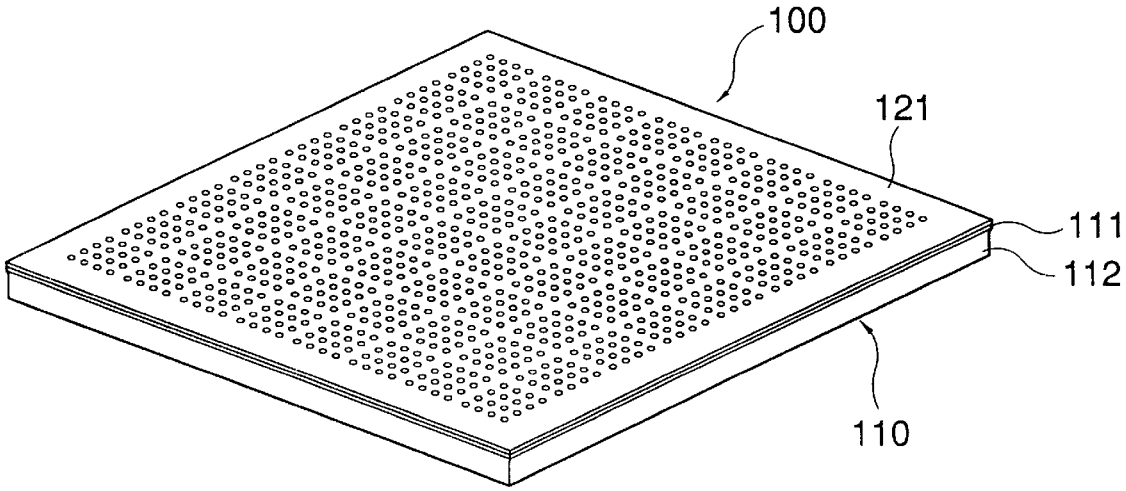
FIG. 3 is a perspective view of a floorboard for clean rooms in accordance with the primary embodiment of the present invention.
Figure 4:
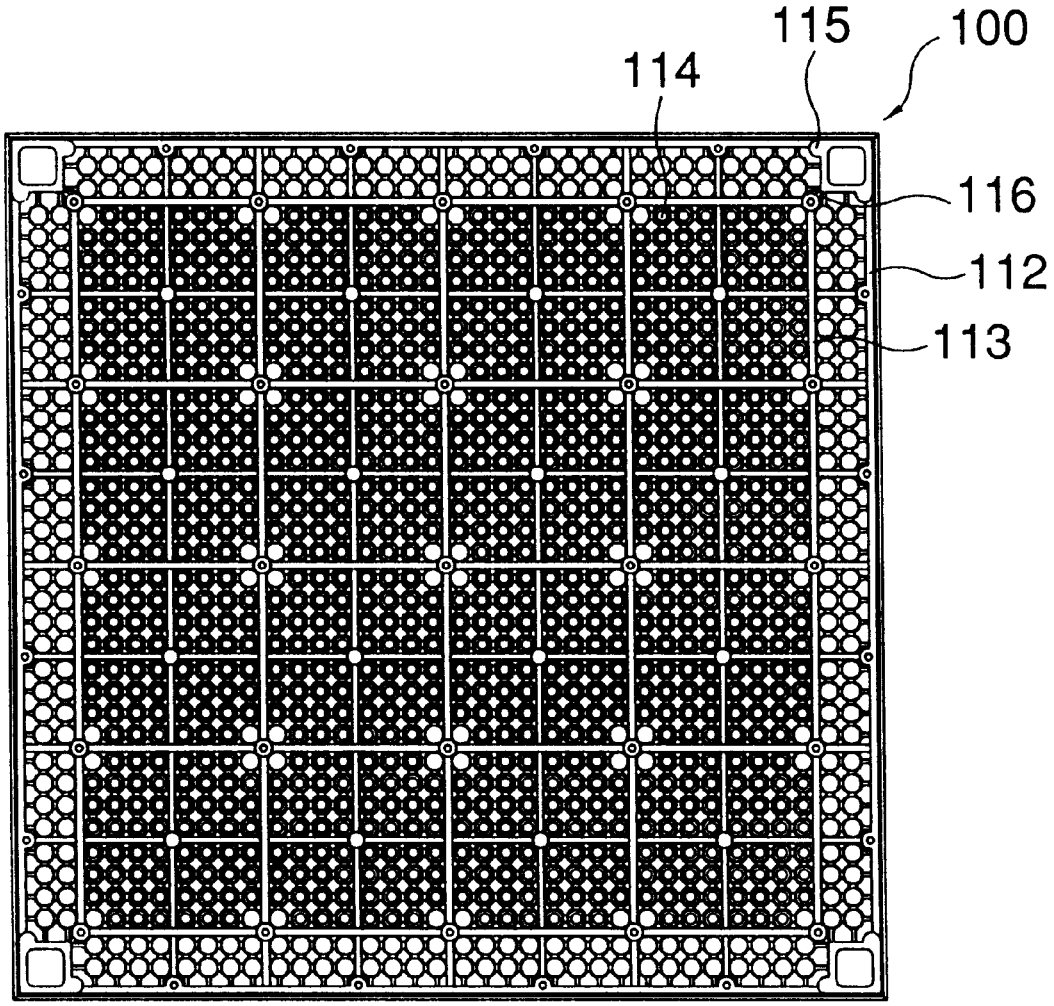
FIG. 4 is a bottom view of the floorboard of this invention, showing the lattice structure of the bottom of said floorboard.
Figure 5:
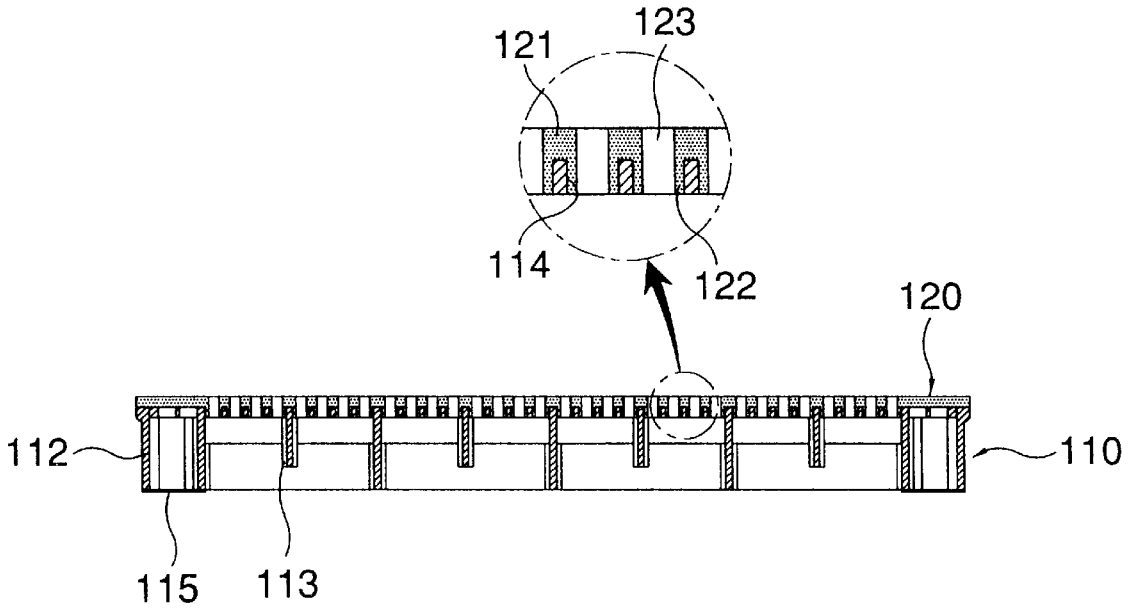
FIG. 5 is a sectional view of the floorboard of this invention, showing the cross-sectioned construction of said floorboard.

FIG. 3 is a perspective view of a floorboard for clean rooms in accordance with the primary embodiment of this invention. FIG. 4 is a bottom view of the above floorboard, showing the lattice structure of the bottom of said floorboard. FIG. 5 is a sectional view of the above floorboard, showing the cross-sectioned construction of said floorboard.

As shown in the drawings, the floorboard 100 for clean rooms of this invention generally comprises two units, a support unit 110 and a tile unit 120. The support unit 110 comprises a plate part 111 having a desired rectangular panel-shaped configuration. A support part 112, having a predetermined height, is vertically and integrally formed along the edge of the lower surface of said plate part 111, thus supporting the plate part 111 when the floorboard is laid on the floor of a clean room. A plurality of reinforcing ribs 113, individually having a predetermined height, linearly, regularly and integrally extend on the lower surface of the plate part 111 within the area defined by the support part 112 in a way such that the ribs 113 integrally cross each other at right angles and integrally meet the support part 112 at right angles, thus forming a desired latticed support structure of the support unit 110. The plate part 111 is perforated at regularly and closely spaced positions through a drilling process, thus having a great number of engaging holes 114. On the other hand, the tile unit 120 comprises a cover part 121 which is assembled with the upper surface of the plate part 111 of the support unit 110. A plurality of engaging projections 122 are formed on the lower surface of the cover part 121 at positions corresponding to the engaging holes 114 of the support unit 110, thus engaging with the engaging holes 114 of said support unit 110. Each of said engaging projections 122 has a ventilation hole 123 at its central portion.

A plurality of corner bosses 115, having a height, are integrally formed on the corners of the support part 112 which are formed along the edge of the lower surface of said plate part 111. Each of the above corner bosses 115 is also integrated with the lattice structure of the reinforcing ribs 113 through a connection part 116. The support part 112 is higher than the reinforcing ribs 113, while the corner bosses 115 are individually higher than the support part 112. Therefore, when the floorboard 100 is laid on the floor of a clean room, the floorboard 100 is smoothly ventilated through the gap defined between the support part 112 and the floor.

The tile unit 120, provided on the top of the support unit 110, is preferably manufactured through an injection molding process. The support unit 110 is made of an aluminum alloy and has a height ranging from 30 mm to 55 mm. On the other hand, the tile unit 120 is made of a synthetic resin material, consisting of 65–75 wt % of polycarbonate and 25–35 wt % of carbon fiber, and has a thickness ranging from about 2 mm to about 10 mm.

Figure 6:
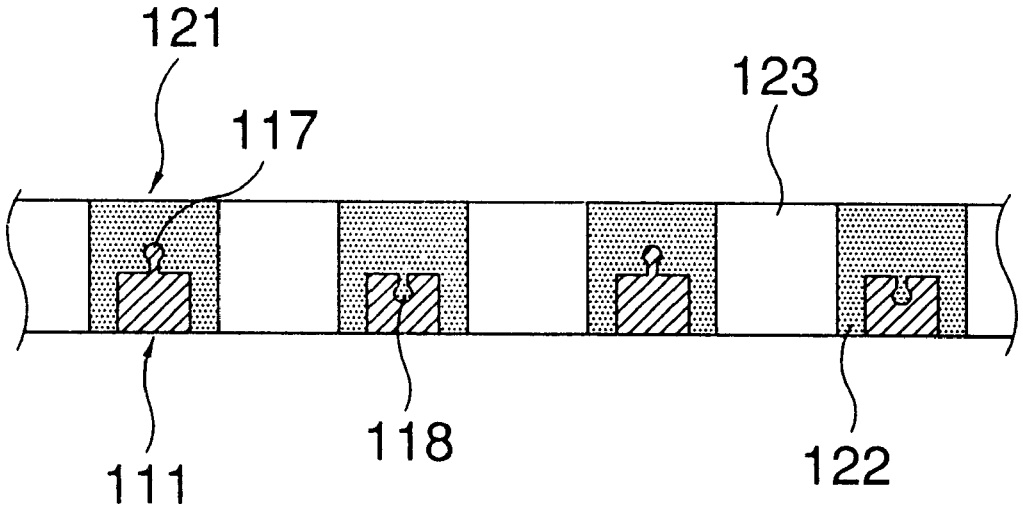
FIG. 6 is a sectional view of a floorboard for clean rooms in accordance with the second embodiment of the present invention, showing the cross-sectioned construction of the floorboard.

FIG. 6 is a sectional view of a floorboard for clean rooms in accordance with the second embodiment of this invention. In the second embodiment, a plurality of locking projections 117 may be formed on the upper surface of the plate part 111 of the support unit 110. Alternatively, a plurality of locking holes 118 may be formed on the upper surface of the plate part 111 in a way such that the locking holes 118 are inclined at an angle of inclination. When the tile unit 120 is formed on the upper surface of the plate part 111 through an injection molding process, the cover part 121 of the tile unit 120 may be integrated with the locking projections 117 of the plate part 111. Alternatively, the cover part 121 of the tile unit 120 may be integrated with the inclined locking holes 118 of the plate part 111. Therefore, it is possible to increase the integration strength between the support unit 110 and the tile unit 120.

In the floorboard 100 of this invention, the engaging projections 122, formed on the lower surface of the cover part 121 of the tile unit 120, are inserted into and engage with the engaging holes 114 formed on the upper surface of the plate part 111. In addition, the cover part 121 of the tile unit 120 is welded to and integrated with the upper surface of the plate part 111 of the support unit 120 through an injection molding process. Therefore, the tile unit 120 of this invention is strongly integrated with the support unit 110.

In addition, each reinforcing rib 113, the support part 112 and each corner boss 115, which are formed on the lower surface of the plate part 111 of the support unit 110, have different heights in a way such that the heights of them are increased in the order of the rib 113, the support part 112 and the corner boss 115. When the floorboard 100 of this invention is laid on the floor of a clean room, air smoothly passes through the gaps defined between the floor and both the support part 112 and the reinforcing ribs 113 of the support unit 110 prior to passing through the ventilation holes 123, so that the floorboard 100 has a desired ventilation effect.

As described above, the present invention provides a floorboard for clean rooms. The floorboard of this invention comprises two units: a support unit and a tile unit. The support unit comprises a plate part which is provided with a support part, a plurality of reinforcing ribs and a plurality of corner bosses at its lower surface. In such a case, each reinforcing rib, the support part and each corner boss have different heights in a way such that the heights of them are increased in the order of the rib, the support part and the corner boss. The plate part also has a plurality of engaging holes. On the other hand, the tile unit comprises a cover part which is assembled with the upper surface of the plate part of said support unit. A plurality of engaging projections are formed on the lower surface of the cover part at positions corresponding to the engaging holes of the support unit, thus engaging with the engaging holes of said support unit when the tile unit is integrated with the support unit through an injection molding process. Each of said engaging projections has a ventilation hole at its central portion. Since the tile unit is welded to and integrated with the upper surface of the support unit through an injection molding process as described above, it is possible to simplify the process of manufacturing the floorboard.

Since the tile unit is welded to the support unit with the engaging projections of the tile unit being inserted into and integrated with the engaging holes of the support unit, the integration strength between the tile unit and the support unit is increased. The integration between the tile unit and the support unit is not deformed or damaged regardless of a temperature variation, so that the floorboard of this invention is used for a lengthy period of time.

In the floorboard of this invention, the tile unit is not bonded to the support unit using a bonding agent, but is welded to and integrated with the support unit through an injection molding process. The floorboard does not emit odors or toxic gas, so that it is not harmful to human bodies.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. A floorboard for clean rooms, comprising:

support unit (110) consisting of:

a plate part (111) provided with a plurality of engaging holes (114) on its upper surface;

a support part (112) vertically and integrally formed along an edge of a lower surface of said plate part; and a plurality of reinforcing ribs (113) linearly, regularly and integrally extending on the lower surface of said plate part in a way such that the ribs are integrated with both the plate part and the support part;

a tile unit (120) integrated with the upper surface of the plate part of the support unit, said tile unit consisting of:

a cover part (121) engaging with the upper surface of said plate part; and a plurality of engaging projections (122) formed on a lower surface of said cover part at positions corresponding to the engaging holes (114) of the support unit (110), thus engaging with the engaging holes of said support unit, each of said engaging projections having a ventilation hole (123) at its central portion.

2. The floorboard according to claim 1, wherein said support unit (110) is made of an aluminum alloy, while said tile unit (120) is made of a synthetic resin material, consisting of 65–75 wt % of polycarbonate and 25–35 wt % of carbon fiber.

3. The floorboard according to claim 1, wherein a plurality of locking projections (117) are formed on the upper surface of said plate part (111), thus increasing the integration strength between the support unit (110) and the tile unit (120).

4. The floorboard according to claim 1, wherein a plurality of inclined locking holes (118) are formed on the upper surface of said plate part (111), thus increasing the integration strength between the support unit (110) and the tile unit (120).

5. The floorboard according to claim 1, wherein said tile unit (120) is formed of an injection molding process.

* * * * *